US006321908B1

(12) United States Patent
Lorscheidt

(10) Patent No.: US 6,321,908 B1
(45) Date of Patent: Nov. 27, 2001

(54) MULTI-CHAMBER CONTAINER

(75) Inventor: Willy Lorscheidt, Pulheim (DE)

(73) Assignee: RPC Wiko GmbH & Co. KG, Pulheim (DE)

( * ) Notice: Subject to any disclaimer, the term of this patent is extended or adjusted under 35 U.S.C. 154(b) by 0 days.

(21) Appl. No.: 09/713,271

(22) Filed: Nov. 15, 2000

Related U.S. Application Data

(63) Continuation of application No. PCT/EP99/03220, filed on May 11, 1999.

(30) Foreign Application Priority Data

May 15, 1998 (DE) ..... 298 08 835 U

(51) Int. Cl.[7] ..... B65D 29/08
(52) U.S. Cl. ..... 206/221; 215/DIG. 8
(58) Field of Search ..... 206/219, 221, 206/568; 215/DIG. 8

(56) References Cited

U.S. PATENT DOCUMENTS 5,277,303 * 1/1994 Goyet et al. ..... 206/221
5,647,481 7/1997 Hundertmark et al. .
6,135,275 * 10/2000 Kelders et al. ..... 206/221

FOREIGN PATENT DOCUMENTS 44 36 863 C1 1/1996 (DE) .
196 35 833 A1 3/1998 (DE) .
297 21 872 U1 3/1998 (DE) .
2 687 640-A1 8/1993 (FR) .

* cited by examiner

*Primary Examiner*—Shian Luong
(74) *Attorney, Agent, or Firm*—Akin, Gump, Strauss, Hauer & Feld, L.L.P.

(57) ABSTRACT

A multi-chamber container comprises a first container for receiving a first product component and a second container for receiving a second product component, the containers being rotationally coupled with one another and each comprising a communication opening for the mutual exchange of the products. Moreover, a closing device is provided for simultaneously closing the two communication openings, the closing device comprising an engaging device for introducing the rotational movement of one container into the closing device, and the closing device further comprising guide devices which are coupled to the other container, such that upon rotational movement the closing device is moved into a position of releasing both communication openings.

12 Claims, 2 Drawing Sheets

Fig. 2
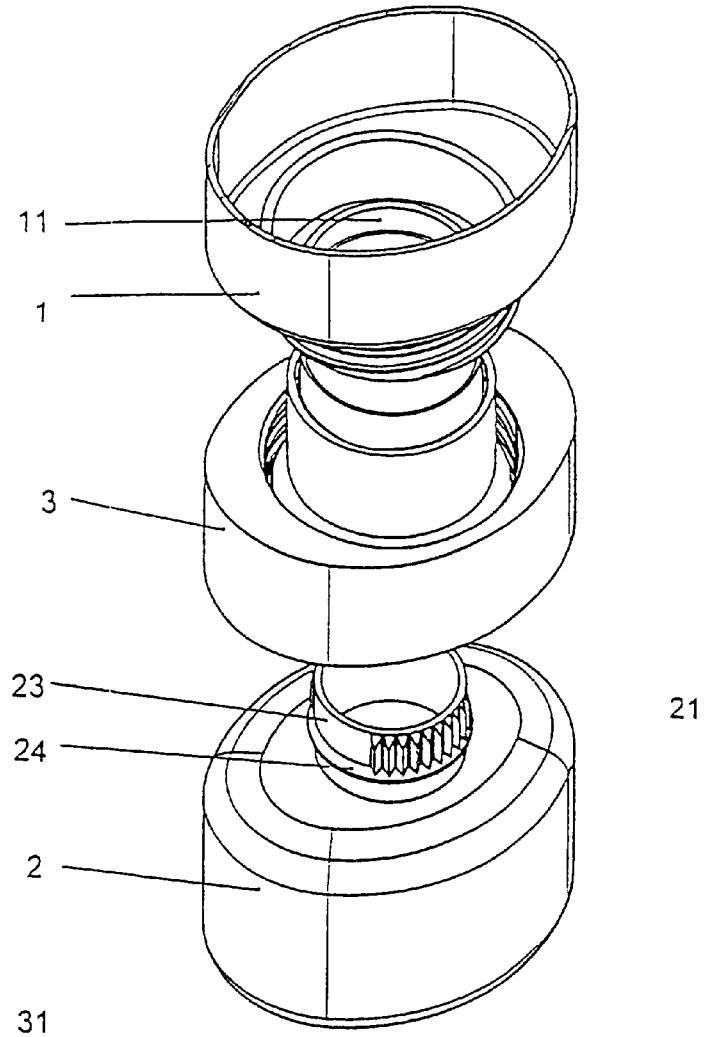
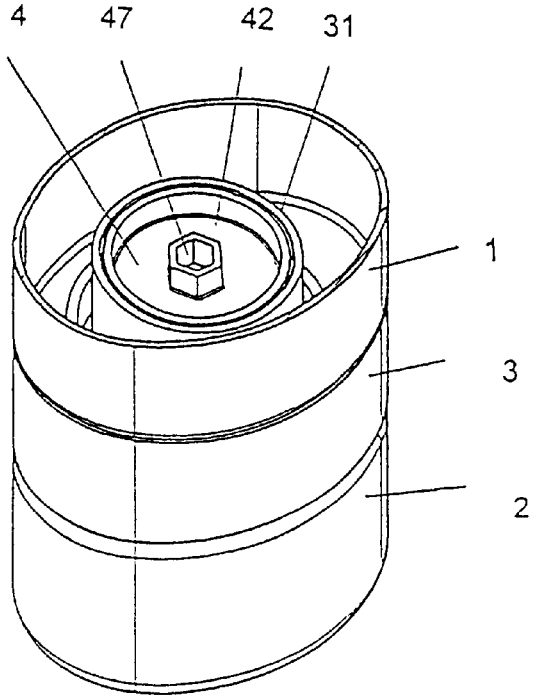
Fig. 3

MULTI-CHAMBER CONTAINER

CROSS REFERENCE TO RELATED APPLICATION

This application is a continuation of International Application PCT/EP99/03220, filed May 11, 1999, the disclosure of which is incorporated herein by reference.

BACKGROUND OF THE INVENTION

The present invention relates to a multi-chamber container in which individual product components can be kept ready in separate containers and in a state where they are isolated from one another and can be intermixed for the purpose of use and can be discharged in their mixed state.

DE-A-37 22 371 discloses a double-chamber container system in which two separate containers are provided for the consumer, each of the containers containing a component of a mixed product. The two containers are assembled for mixing the individual components, each of the containers being provided for this purpose with a communication opening that is closed by a cover of its own. Before the two containers are assembled, the consumer must first remove the cover of the lower container. This lower container is then screwed onto the other container, with the cover of the upper container being simultaneously opened and the product components being subsequently mixable. Apart from the fact that the handling of the known two-component container is troublesome because of the opening and closing operations to be performed by the consumer, there is also the risk that the consumer inadvertently unscrews the container that is now containing the mixed product, which leads to an uncontrolled escape of the mixed product.

BRIEF SUMMARY OF THE INVENTION

It is therefore an object of the present invention to simplify the general handling of a multi-chamber container and to increase handling safety.

This object is achieved by a multi-chamber container comprising at least one first container for receiving a first product component and a second container for receiving a second product component. The two containers are rotationally coupled with one another and are each provided with a communication opening for the mutual exchange of products. Furthermore, there is provided a closing device for simultaneously closing the two communication openings. The closing device comprises an engaging device for introducing the rotational movement of one container into the closing device. Furthermore, the closing device comprises guide devices, which are coupled to the other container directly or indirectly. They are coupled such that upon a rotational movement of the closing device the device is moved into a position releasing both communication openings. This multi-chamber container is made available to the consumer in its already fully mounted state, so that the consumer need no longer assemble the individual containers. The containers need just be rotated relative to one another for mixing the components, with the communication openings of the containers that are rotated relative to one another being opened at the same time.

This makes handling much easier for the supply containers in which individual product components have to be stored separately until use. Moreover, a uniform outer appearance is achieved with the already assembled multi-chamber container, whereby user acceptance is also improved.

The solution of the invention is not limited to multi-chamber containers having two separate containers, but may cover any desired number of containers coupled in a corresponding manner according to the described concept of the invention.

In a preferred embodiment, the closing device comprises a first sealing section for closing the one communication opening and a second sealing section for closing the second communication opening. The two sealing sections are integrally coupled with one another by a tapered connecting section. As a result, an air cushion is formed in the area between the communication openings, the air cushion counteracting a diffusion exchange of the product components past the closing device. Hence, any premature reaction of the product components with one another can be avoided in a reliable manner, resulting in long durability for the product components in their separated state.

In a further advantageous embodiment, an intermediate member, which is coupled with the one container for rotation therewith and is rotatable relative to the other container, is arranged in the communication portion between the communication openings. To this end, the one container and the intermediate member have provided thereon coupling elements which ensure engagement in the rotational direction, but permit axial displacement relative to one another. The coupling elements are preferably designed as a toothing. It is thereby possible to assemble the two containers through simple axial attachment without the need for a relative rotational movement between the containers, which would be more troublesome under manufacturing aspects.

According to a further development of the invention, engaging elements are provided on the intermediate member and on the one container for the mutual axial definition of the position. Preferably, the engaging elements are designed in the manner of ramps, said ramps being inclined to promote a first sliding movement of the engaging elements one on top of the other and to prevent a re-withdrawal movement. It is thereby possible in an advantageous manner with respect to manufacture to achieve an axial locking between the two containers at the end of the attaching operation, which locking, in addition, can no longer be undone by the consumer. Any undesired separation and thus an uncontrolled release of the mixed product is thereby prevented in a reliable manner.

According to a further advantageous development of the invention, the intermediate member is provided on its end facing the other container with a surrounding sealing lip, which sealingly rests on an inner wall of a communication portion. Since the seal is directly arranged on the product, one obtains a substantially smooth inner chamber which, in contrast to a rough inner chamber, helps to exploit the mixed product in an improved manner when the container is being emptied. Moreover, an undesired escape of mixed product between the intermediate member and the corresponding container is efficiently prevented.

Further advantageous developments of the invention are described below and in the dependent claims.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIG. 2 is a three-dimensional view illustrating the part of the embodiment shown in FIG. 1, in the exploded state; and FIG. 3 is a three-dimensional view of the part of the embodiment illustrated in detail in FIG. 1, in the assembled state.

DETAILED DESCRIPTION OF THE INVENTION

Figure 1:
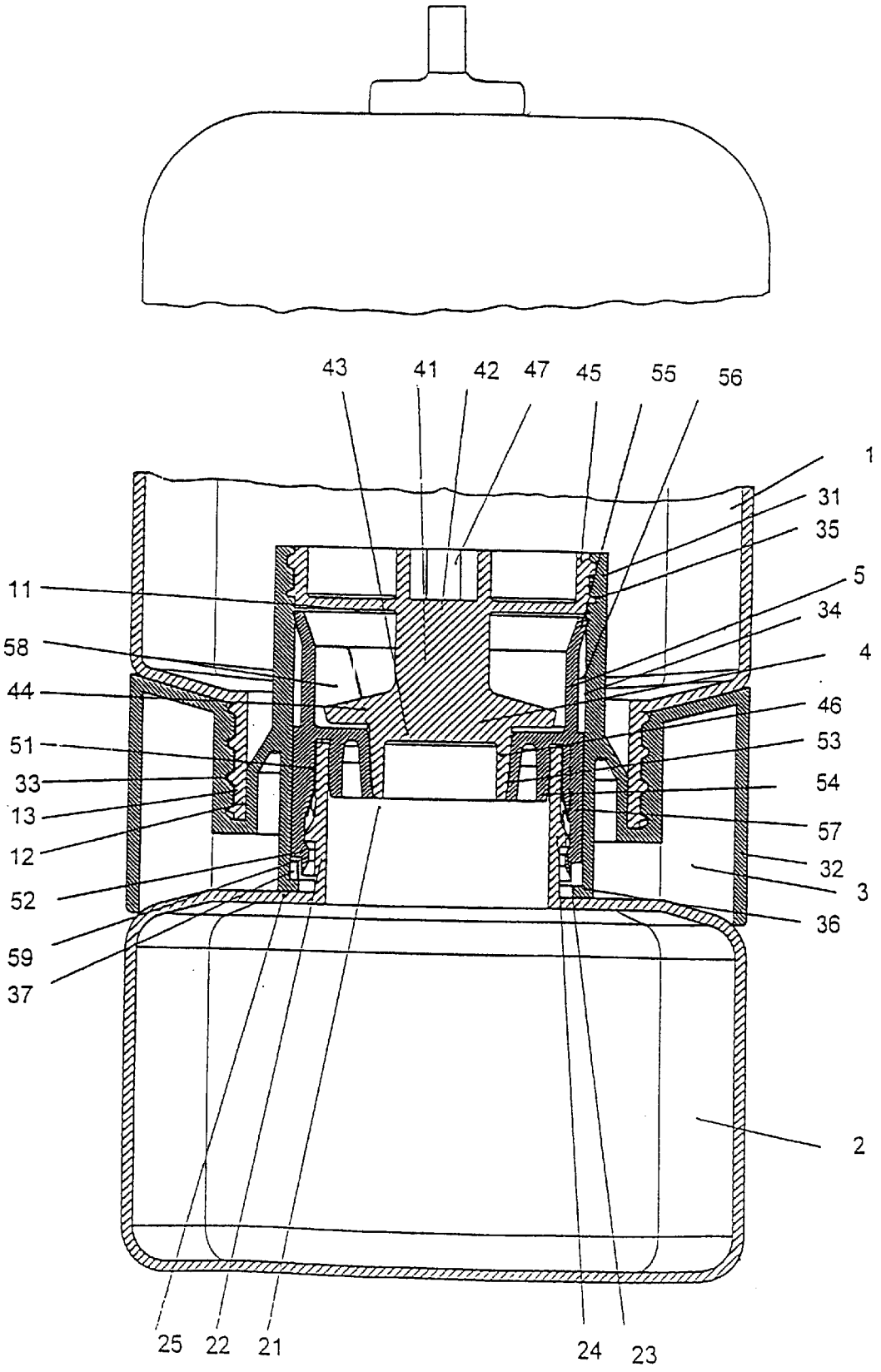
FIG. 1 is a sectional view illustrating an embodiment of the invention including two containers, with the upper end of the upper container being just sketched.

The multi-chamber container according to the embodiment comprises a first container 1 for receiving a first product component and a second container 2 for receiving a second product component The two containers are arranged one above the other with respect to a longitudinal axis of the multi-chamber container and are supported relative to one another via a coupling member 3.

As shown in FIG. 3, the two containers 1, 2 and the coupling member 3 have an elliptical shape when viewed in cross-section, their outer surface being in flush alignment for achieving a uniform appearance. However, the containers and the coupling member may have any other cross-sectional shape; for instance, all of them may be provided with a circular cross-section.

At its end facing the other container 2, the container 1 comprises a communication opening 11 and a neck 12 for connection to the coupling member 3. In the illustrated embodiment, a threaded connection 13/33 is provided for obtaining a firm connection between the first container 1 and the coupling member 3, but the two members may just as well be locked in anti-rotational fashion.

The coupling member comprises a sleeve section 31 which extends into the communication opening 11 of the first container 1 and which is connected to an outer sleeve section 32 via a transition section which receives the neck 12 of the first container. In principle, the first container 1 and the coupling member 3 may also be shaped as an integral one-part piece. A two-part design, however, offers technical advantages with respect to manufacture.

At its end facing the second container, the sleeve section 31 of the coupling member 3 comprises a stop collar 36 for support on a substantially horizontally extending wall section 25 of the second container 2. The second container 2 is rotationally movable relative to the coupling member 3.

On its side oriented towards the first container the second container 2 has a sleeve-like projection 22 including a communication opening 21 which extends into the sleeve section 31 of the coupling member 3.

An engaging device is externally provided on the sleeve-like section 22 of the second container 2 in the form of a toothing which allows engagement in the rotational direction about the longitudinal axis and displacement in the axial direction. A ramp-like annular projection 24, the ramp of which rises in the direction of the second container 2 and has an undercut substantially formed in a direction transverse to the longitudinal direction, is externally provided underneath the toothing 23 on the sleeve section 21.

Furthermore, a sleeve-like intermediate member 5 is inserted into the sleeve section 31 of the coupling member 3. This intermediate member 5 is supported in the axial direction of the second container 2 relative to the coupling member 3 and is provided at its end facing the first container 1 with a surrounding sealing lip 55 which sealingly rests on an inner wall 34 of the sleeve section 31, resulting in a relatively smooth conclusion in the transition area between the communication openings 11 and 21. To achieve an elastic contact force on the inner wall 34 of the sleeve section 31, the sealing lip section 55 is slightly curved outwards, resulting in an annular intermediate chamber 56 underneath the sealing edge.

The sealing lip section 55 is followed in the direction of the second container 2 by a sleeve section 57, which extends between the sleeve section 21 of the second container 2 and the sleeve section 31 of the coupling member 3, and slidingly rests with its outer wall on the inner wall 34 of the sleeve section 31. On the inside, this sleeve section 57 comprises coupling elements, preferably a toothing 51 for engagement with the toothing 23 of the second container 2. Furthermore, an engagement element, preferably in the form of an inner projection 52, is provided on the sleeve section 57 of the intermediate member 5. This projection 52 is of a surrounding type and has a substantially trapezoidal shape when viewed in cross-section. Thanks to its construction on the end of the sleeve section 57 that is oriented towards the second container, said projection 52 can easily slide over the ramp-like annular projection 24 of the sleeve member 21 when the two containers 1 and 2 are assembled. On account of the undercut of the annular projection 24, it is extremely difficult to sever said connection, so that during normal use of the multi-chamber container, the containers 1 and 2 cannot be separated by the consumer.

Furthermore, the intermediate member 5 comprises a sealing section which in the dosed state sealingly extends between a closing stopper 4, which will be described in more detail hereinafter and the sleeve section 21 of the second container 2. The sealing section is of a surrounding type and has a substantially U-shaped cross-sectional profile whose two arms extend into the sleeve section 21. The outer arm 54 of the sealing section seals the second container 2 to the outside due to an elastic contact on an inner wall section of the sleeve section 21, while the radially inner arm 53 of the U-shaped profile elastically rests on the closing stopper 4 in the closed state.

Furthermore, the sleeve section 31 of the coupling member 3 receives the closing stopper 4, which has already been mentioned. This closing stopper has a tapered, substantially cylindrically shaped center section 41 which integrally connects the axially spaced-apart sealing sections 42 and 43 to each other for closing the corresponding communication openings 11 and 21. The first sealing section 42 is essentially pot-shaped and provided on its radial outer circumference with a thread 45 which in the closed state is in engagement with a corresponding thread 35 on the sleeve section 31 to seal the first container 1. The second sealing section 43 on the opposite end projects into the sleeve section 21 of the second container 2 and sealingly rests with its radial outer surfaces on the surrounding arm 53. Since the two sealing sections 42 and 43 are clearly spaced apart in axial direction, one obtains a diffusion barrier in the overflow region inside the sleeve section 31, in particular due to the air cushion formed around the tapered section 41, with the diffusion barrier considerably reducing a molecular exchange between the product components (such an exchange being never entirely avoidable in plastic seals), whereby durability of the product components in the separated state can be considerably increased.

Furthermore, the closing device 4 comprises an engaging device, which in the illustrated embodiment is formed by engaging projections 44 that radially extend in star-shaped fashion. Radially inwardly extending wing-like projections 58 are preferably provided in an identical number also on the intermediate member 5, the projections 58 being arranged above the sleeve section 57 and also above the sealing section 53, 54 of the intermediate member 5. A rotational movement which has been applied to the intermediate member 5 is transmitted by these wing-like projections 58 by means of the engaging projections 44 onto the closing stopper 4, so that the stopper is screwed out of the thread 35 of the coupling member 3. During the accompanying axial movement of the closing device 5 and the subsequent release of the device, the communication openings 11 and 21 are released, whereby the product components can be mixed.

In particular in storage containers having a non-circular cross-sectional shape, the possible relative movement between the second container 2 and the first container 1 is limited in such a manner that a flush outer contour of the multi-chamber container is again obtained after release of the closing stopper 4 and after the product components have been mixed. Preferably, an irrevocable locking possibility is additionally provided for in this position, so that the user can no longer perform a rotational return movement after the mixing process has been carried out. Thus, if corresponding marks are provided on the containers, the user can see whether the mixing operation has already been started so as to distinguish a multi-chamber container with an already mixed product from one in which the product has not been mixed yet.

For this purpose, the lower end of the sleeve section 31 has provided thereat an engaging cam 37 which cooperates in the above-described manner with a groove 59 provided in the corresponding region of the intermediate member 5.

In the same manner as described above, one or more containers can be mounted in the same manner on the multi-chamber container which in the embodiment consists of two containers, so that mixtures consisting of three or more components can also be mixed in case of need. Liquid and paste-like compounds, which may additionally contain solid particles, can here be used as products.

All components of the multi-chamber container can be produced as plastic injection-molded parts, to which end polyethylene or PVC is used, for example.

Assembly and filling of the multi-chamber container according to the embodiment will now be briefly described.

During assembly the intermediate member 5 is first inserted into the sleeve section 31 in the coupling member 3, in FIG. 1 from above. The closing device 4 is subsequently screwed in, to which end the engaging opening 47 is provided as a mounting aid for the attachment of a hexagon, for example. Subsequently, the upper container 1 can firmly be screwed on. In the end, the subassembly consisting of the previously mentioned members is mounted on the already filled second container 2 by performing an axial movement, the engaging projections 52 of the intermediate member 5 snapping over the ramp-like annular projection 24 of the second container, whereby the said subassembly and the second container are undetachably connected to each other.

In this state in which the filled multi-chamber container is normally offered to the consumer, the closing device is in the closing position, so that the product components are separated from one another.

During use the first and second containers are rotated relative to one another. In such a case the toothing 23 of the second container 2 transmits the rotational movement across the toothing 51 to the intermediate member 5 which slidingly rotates on the inner wall 34 of the sleeve section 31. The rotational movement is further transmitted by the wing-like projections 58 onto the closing device 4 which is axially moved upwards due to its threaded toothing 45 with the sleeve section 31 until the communication openings 11 and 21 are released, whereupon the product is mixed. The two containers are held in the rotated position by the groove/cam arrangement 37/59, and a rotational return movement is no longer possible.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A multi-chamber container comprising:

a first container (1) for receiving a first product component, and a second container (2) for receiving a second product component, said containers being rotationally coupled with one another and each comprising a communication opening (11, 21) for the mutual exchange of products, and a closing device (4) for simultaneously closing the two communication openings (11, 21), said closing device comprising an engaging device for introducing the rotational movement of the second container (2) into the closing device (4), and said closing device further comprising guide devices (45) which are coupled to the first container (1) directly or indirectly in such a manner that upon a rotational movement the closing device (4) is moved into a position releasing both communication openings (11, 21), wherein the closing device (4) comprises a first sealing section (42) for closing the first communication opening (11) and a second sealing section (43) for closing the second communication opening (21), said sealing sections being integrally coupled with one another by a connecting section (41).

2. The multi-chamber container according to claim 1, wherein the first sealing section (42), the second sealing section (43) and the connecting section (41) of the closing device (4) form a closing stopper, wherein the connecting section (41) is taper shaped.

3. The multi-chamber container according to claim 1, wherein a plurality of substantially radially extending engaging projections (44) are provided as the engaging device in star-shaped configuration on the connecting section (41).

4. The multi-chamber container according to claim 1, wherein the guide devices have a rotary thread.

5. The multi-chamber container according to claim 1, wherein an intermediate member (5), which is coupled with the second container (2) for rotation therewith and is rotatable relative to the first container (1), is arranged in a communication portion between the communication openings (11, 21), with coupling elements that are provided on the second container (2), and the intermediate member (5) being designed to permit an axial displacement.

6. The multi-chamber container according to claim 5, wherein the coupling elements are designed as a toothing.

7. The multi-chamber container according to claim 5, wherein the intermediate member (5) and the second container (2) comprise engaging elements (24, 52) for axially defining a position relative to one another.

8. The multi-chamber container according to claim 7, wherein said engaging elements (24, 52) are designed in a manner of ramps, said ramps being inclined to promote a sliding movement one on top of another and to prevent a re-withdrawal movement.

9. The multi-chamber container according to claim 5, wherein the intermediate member (5) is provided at an end facing the first container (1) with a surrounding sealing lip (55) which sealingly rests on an inner wall (34) in an overflow region.

10. The multi-chamber container according to claim 5, wherein the intermediate member (5) comprises a sealing section (53, 54) which in the closed state of the multi-component container sealingly extends between the closing device (4) and the second container (2).

11. The multi-chamber container according to claim 1, wherein means (37, 59) are provided between the first and second containers (1, 2) for defining the rotational movement, said means being preferably additionally designed in such a manner that a rotary return movement is stopped after the communication openings (11, 21) have been opened.

12. The multi-chamber container according to claim 1, wherein the first and second containers (1, 2) are supported relative to one another via a coupling member (3) provided between said containers, the coupling member (3) being firmly connected to a container (1) and receiving the closing device (4) and a intermediate member (5).

* * * * *